US009381655B2

(12) United States Patent
Lau

(10) Patent No.: US 9,381,655 B2
(45) Date of Patent: Jul. 5, 2016

(54) DOUBLE-BLADE HAIR TRIMMING DEVICE

(71) Applicant: Tung Yan Lau, Guangdong Province (CN)

(72) Inventor: Tung Yan Lau, Guangdong Province (CN)

(73) Assignee: SPECIALIFE (ZHUHAI) CO., LTD., Guangdong Province (CN)

( * ) Notice: Subject to any disclaimer, the term of this patent is extended or adjusted under 35 U.S.C. 154(b) by 335 days.

(21) Appl. No.: 13/943,765

(22) Filed: Jul. 16, 2013

(65) Prior Publication Data

US 2014/0026422 A1 Jan. 30, 2014

(30) Foreign Application Priority Data

Jul. 26, 2012 (CN) ..... 2012 1 0261015

(51) Int. Cl.

| | |
|---|---|
| ***B26B 19/10*** | (2006.01) |
| ***B26B 19/06*** | (2006.01) |
| ***B26B 19/20*** | (2006.01) |
| ***B26B 19/22*** | (2006.01) |
| ***B26B 19/38*** | (2006.01) |

(52) U.S. Cl.

CPC ..... *B26B 19/10* (2013.01); *B26B 19/06* (2013.01); *B26B 19/20* (2013.01); *B26B 19/22* (2013.01); *B26B 19/3846* (2013.01)

(58) Field of Classification Search

CPC .... B26B 19/10; B26B 19/102; B26B 19/105; B26B 19/107

USPC ..... 30/30, 34.1, 43.91, 43.92, 194, 195, 30/208–210

See application file for complete search history.

(56) References Cited

U.S. PATENT DOCUMENTS

| | | | | | |
|---|---|---|---|---|---|
| 458,940 | A * | 9/1891 | Bonham | B26B 19/066 | 30/197 |
| 871,082 | A * | 11/1907 | Brigham | B26B 21/38 | 30/43.92 |
| 874,932 | A * | 12/1907 | Brigham | B26B 19/36 | 30/30 |
| 1,089,727 | A * | 3/1914 | Sharpnack | B26B 21/38 | 30/43.92 |
| 1,380,272 | A * | 5/1921 | Tomasulo | B26B 19/36 | 30/34.1 |
| 1,489,198 | A * | 4/1924 | Vincenti | B26B 19/32 | 30/43.92 |
| 1,519,601 | A * | 12/1924 | Tomasulo | B26B 19/28 | 30/218 |
| 2,029,791 | A * | 2/1936 | Pluchino | B26B 19/06 | 30/34.1 |
| 2,077,367 | A * | 4/1937 | Hanley | B26B 19/06 | 30/43.92 |
| 2,083,580 | A * | 6/1937 | Schmitt | B26B 19/3806 | 30/43.92 |
| 2,101,737 | A * | 12/1937 | Gesler | B26B 21/34 | 30/30 |
| 2,194,465 | A * | 3/1940 | Bott | B26B 19/06 | 30/43.92 |

(Continued)

FOREIGN PATENT DOCUMENTS

| | | | |
|---|---|---|---|
| DE | 202013103187 U1 | * | 7/2013 |
| GB | 2506958 A | * | 4/2014 |

*Primary Examiner* — Jason Daniel Prone

(57) ABSTRACT

A double-blade hair trimming device having a trimmer handle, a blade head, and a driving device disposed inside the trimmer handle. The device has both a thick blade unit used for trimming hard, thick and long hair, and a thin blade unit used for trimming short and fine hair. Hair on the skin can be tidily trimmed by just one shave or one shave in each of two opposite directions. The length of the hair after shaving is less than 0.1 mm.

5 Claims, 7 Drawing Sheets

(56) References Cited

U.S. PATENT DOCUMENTS 2,229,959 A * 1/1941 Dalkowitz ..... B26B 19/02 30/43.92
2,256,326 A * 9/1941 Quino ..... B26B 21/125 30/30
2,300,143 A * 10/1942 Berg ..... B26B 19/10 30/34.1
2,345,695 A * 4/1944 Andis ..... B26B 19/10 30/210
2,350,805 A * 6/1944 Olving ..... B26B 19/02 30/34.1
2,448,219 A * 8/1948 Hirsch ..... B26B 19/06 30/43.92
2,484,610 A * 10/1949 Cromonic ..... B26B 19/06 30/210
2,488,436 A * 11/1949 Santoro, Sr. ..... B26B 21/12 30/30
2,568,368 A * 9/1951 Sayer et al. ..... B26B 21/12 30/30
2,641,055 A * 6/1953 Mansfield ..... B26B 21/08 30/30
2,715,266 A * 8/1955 Haislip ..... B26B 19/20 30/43.92
2,948,063 A * 8/1960 Jepson ..... B26B 19/042 30/34.1
2,955,355 A * 10/1960 Tornvall ..... B26B 21/12 30/30
3,183,589 A * 5/1965 Szabo ..... B26B 21/08 30/30
3,238,616 A * 3/1966 Eweson ..... B26B 21/12 30/30
3,343,258 A * 9/1967 Loner ..... B26B 19/10 30/34.1
3,358,367 A * 12/1967 Bartley ..... B26B 21/12 30/30
3,453,728 A * 7/1969 Loner ..... B26B 19/10 30/34.1
3,523,364 A * 8/1970 Crisanti ..... B26B 21/08 30/30
D219,502 S * 12/1970 Morris ..... 30/30
3,621,569 A * 11/1971 Morris ..... B26B 21/08 30/30
3,699,653 A * 10/1972 Miller ..... B26B 21/08 30/30
3,774,300 A * 11/1973 Konig ..... B26B 19/10 30/34.1
3,947,960 A * 4/1976 Urbaniak ..... B26B 21/10 30/30
3,950,847 A * 4/1976 Duda ..... B26B 19/10 30/34.1
4,011,656 A * 3/1977 Liedtke ..... B26B 21/00 30/30
4,174,568 A * 11/1979 Mixner ..... B26B 19/10 30/34.1
4,649,642 A * 3/1987 Nagasaki ..... B26B 19/06 30/34.1
5,461,780 A * 10/1995 Morana ..... B26B 21/12 30/30
5,504,997 A * 4/1996 Lee ..... B26B 19/02 30/34.1
6,314,648 B1 * 11/2001 Hillebrandt ..... B26B 19/10 30/34.1
6,317,982 B1 * 11/2001 Andrew ..... B26B 19/102 30/34.1
6,405,439 B1 * 6/2002 Malobabic ..... B26B 19/06 30/43.92
6,502,312 B2 * 1/2003 Beutel ..... B26B 19/063 30/34.1
6,604,287 B2 * 8/2003 Melton ..... B26B 19/06 30/34.1
6,684,507 B2 * 2/2004 Lau ..... B26B 19/10 30/34.1
7,721,451 B2 * 5/2010 Psimadas ..... B26B 21/22 30/34.1
7,900,359 B2 * 3/2011 Royle ..... B26B 19/063 30/34.1
8,136,250 B2 * 3/2012 Floessholzer ..... B26B 19/06 30/43.92
8,726,517 B2 * 5/2014 Lau ..... B26B 19/06 30/34.1
2003/0106219 A1 * 6/2003 Lau ..... B26B 19/063 30/34.1
2012/0137524 A1 * 6/2012 Mikula ..... B26B 19/20 30/34.1
2014/0317932 A1 * 10/2014 Van Straaten ..... B26B 19/06 30/34.1
2015/0251326 A1 * 9/2015 Lombardo ..... B26B 19/148 30/29.5
2016/0059428 A1 * 3/2016 Lau ..... B26B 19/06 30/30

* cited by examiner

DOUBLE-BLADE HAIR TRIMMING DEVICE

BACKGROUND OF THE INVENTION

The present invention relates to the field of electric personal care product, and more specifically relates to a kind of double-blade hair trimming device.

At present, a hair trimming device comprises a foil in the middle and trimming blades on the two sides. The disadvantage is that after using the trimming blade, it is difficult for a user to align the hair with the meshes of the foil and put the hair through. The user needs to move back and forth repeatedly in order to finish trimming by the foil. Yet, during the reciprocating movement, the trimming blade may trim away the hair that the user may like to keep. In the case of armpit hair-trimming, the trimming blades may cut the skin when using the foil.

There is another type of hair trimming device, wherein a razor is added onto the trimming device. The razor can be hidden, so in this case the trimming device can be used alone. Alternatively, the razor can be extended. The longer hair can first be trimmed by the trimming device disposed in the front position. After that, the razor disposed in the back position can be used to shave. Another option is that the razor can be extended fully such that it can be used directly. The disadvantage is that this combination of blade heads is difficult to control. One needs to manage the use angles of the trimming device and the razor at the same time. The user may worry that the razor may cut the skin and affect the trimming effects, especially on the sensitive area.

BRIEF SUMMARY OF THE INVENTION

In view of the aforesaid disadvantages now present in the prior art, the present invention provides a kind of double-blade trimming device which is safer to use.

The present invention adopts the following technical proposal:

A double-blade hair trimming device which comprises a blade body, a blade head, and a driving device disposed inside the blade body, wherein the blade head comprises a thick blade unit and a thin blade unit which are disposed side by side.

The thick blade unit is a thick blade assembly, whereas the thin blade unit is a thin blade assembly. The thick blade assembly and the thin blade assembly are disposed in the same direction. The thin blade assembly is disposed rear to the thick blade assembly.

The thick blade assembly comprises a thick fixed blade and a first movable blade. The thin blade assembly comprises a thin fixed blade and a second movable blade. The thick fixed blade, the first movable blade, the thin fixed blade and the second movable blade each has an edge which is provided with a teeth section. The first movable blade is sleeved within an inner side of thick fixed blade, and the teeth sections thereof overlap with each other correspondingly. The first movable blade moves reciprocally corresponding to the thick fixed blade; when the teeth sections of the first movable blade and the thick fixed blade engage with each other, a thick blade trimming surface is formed without any gaps therebetween. The second movable blade is sleeved within an inner side of thin fixed blade, and the teeth sections thereof overlap with each other correspondingly. The second movable blade moves reciprocally corresponding to the thin fixed blade; when the teeth sections of the second movable blade and the thin fixed blade engage with each other, a thin blade trimming surface is formed without any gaps therebetween. The thick blade trimming surface and the thin blade trimming surface are disposed side by side and face the same direction. The thin fixed blade has a tooth thickness of less than 0.1 mm.

The teeth section of the thick fixed blade comprises serrated openings which are evenly arranged on an edge thereof along a lengthwise direction. The teeth section of the first movable blade comprises a plurality of teeth which are evenly arranged on an edge thereof along a lengthwise direction, wherein each of the teeth has a V-shaped pointing end, a V-shaped cross section, and two edges which are both disposed with blades. The teeth section of the thin fixed blade comprises a plurality of teeth which are evenly arranged along an edge thereof along a lengthwise direction, wherein each of the teeth has a V-shaped pointing end and two edges which are both disposed with blades. The teeth section of the second movable blade comprises a plurality of teeth which are evenly arranged along an edge thereof along a lengthwise direction, wherein each of the teeth has a V-shaped pointing end and two edges which are both disposed with blades.

The blade head also comprises a blade head protection line which is disposed between the teeth of the thick fixed blade and the thin fixed blade, and is parallel to the thick blade trimming surface and the thin blade trimming surface. Specifically, it is disposed at a front end of the thin fixed blade. When the present invention is in use, the thick blade assembly is first used to shave the skin, then the blade head protection line will stretch the skin which has been shaved by the thick blade assembly. Afterwards, the thin blade assembly is used to shave.

The blade head protection line is an independent component, or a protrusion on a surface of the thick fixed blade, or an elongated component of the blade head protection cover which is parallel to both the thick blade trimming surface and the thin blade trimming surface.

The blade head comprises a blade head cover case which is used to accommodate the thick blade assembly and the thin blade assembly.

The blade head comprises a blade head protection cover which is engaged with the blade head cover case. The blade head protection cover has a side edge which is provided with a row of openings corresponding to shape, density and size of spacing of the teeth of the thick fixed blade, forming a guiding groove which facilitates entry of hair between the teeth of the first movable blade.

The teeth of the thick fixed blade are engaged with an end of the row of openings of the blade head protection cover. The teeth of the first movable blade are concealed within a cavity formed by the engagement of the teeth of the thick fixed blade and the row of openings.

The thick blade unit is a thick blade teeth edge, whereas the thin blade assembly is a thin blade teeth edge. The thick blade teeth edge and the thin blade teeth edge are reversely disposed.

The blade head comprises a fixed blade and a movable blade. Axes of the fixed blade and the movable blade overlap. The fixed blade and the movable blade are each provided with teeth sections at two opposite edges thereof. The fixed blade is sleeved within an inner side of the movable blade. The teeth sections of the fixed blade and the movable blade overlap with each other correspondingly. The movable blade moves reciprocally corresponding to the fixed blade to trim away hair. One of the edges of the fixed blade is relatively thicker than the edge opposite thereto. The thicker edge of the fixed blade overlaps with one of the edges of the movable blade to form the thick blade teeth edge. The thinner edge of the fixed blade overlaps with the other edge of the movable blade to form the thin blade teeth edge. Inner sides of the teeth sections of the fixed blade of the thick blade teeth edge and the thin blade teeth edge are engaged with outer sides of the teeth sections of the movable blade of the thick blade teeth edge and the thin blade teeth edge without any gaps to form trimming surfaces for hair trimming. The teeth section of the thinner edge of the fixed blade has a tooth thickness of less than 0.1 mm.

The teeth section of the thicker edge of the fixed blade comprises serrated openings which are evenly arranged along a lengthwise direction of that edge. The teeth section of the thinner edge of the fixed blade comprises a plurality of teeth which are evenly arranged along a lengthwise direction of that edge, wherein each of the teeth has a V-shaped pointing end and two edges which are both disposed with blades.

The teeth sections of the two edges of the movable blade each comprises a plurality of teeth which are evenly arranged along a lengthwise direction of the edge; each of the teeth has a V-shaped pointing end, a V-shaped cross section, and two edges which are both disposed with blades.

The blade head also comprises a blade head protection line which is disposed at a side of thin blade teeth edge which is far away from the thick blade teeth edge. It is parallel to both the thin blade teeth edge and the thick blade teeth edge and is located on the same plane as an outer surface of the fixed blade.

The blade head protection line is an independent component, with its two ends fixed onto a case of a double-sided double-blade hair trimming device.

The blade head protection line can also be an elongated protrusion on a surface of a case of a double-sided double-blade hair trimming device which is parallel to both the thick blade teeth edge and the thin blade teeth edge.

Compared with the prior art, the present invention has the following advantages:

When carrying out a first shave with the double-sided double-blade hair trimming device of the present invention, the thick blade teeth edge can remove the thick and long hair. After that, by shaving in a reverse way, the remaining short and fine hair will be removed by the thin blade teeth edge. The length of the hair of the skin being shaved can be less than 0.1 mm, thus attaining the effect of a razor. The blade head protection line can stretch and flatten the skin which has been shaved by the thick blade teeth edge, hence the rough area of the skin will not be scratched by the thin blade assembly during shaving. Also, the present invention is suitable for shaving twice in opposite directions. This allows the user to shave away all thick and long hair during the first shave, and keep the hair he likes during the second shave. The present invention is simple in structure and convenient to use.

The single-sided double-blade hair trimming device of the present invention is disposed with a thick blade assembly and a thin blade assembly at the same trimming direction. Thick and long hair can be removed by the thick blade assembly by only one shave without the need for accurate alignment, and the remaining short and fine hair can be removed by the thin blade assembly. The length of the hair of the skin being shaved can be less than 0.1 mm. The blade head protection line can stretch and flatten the skin which has been shaved by the thick blade assembly, hence the rough area of the skin will not be scratched by the thin blade assembly during shaving.

DETAILED DESCRIPTION OF THE INVENTION

Embodiment 1

Figure 1:
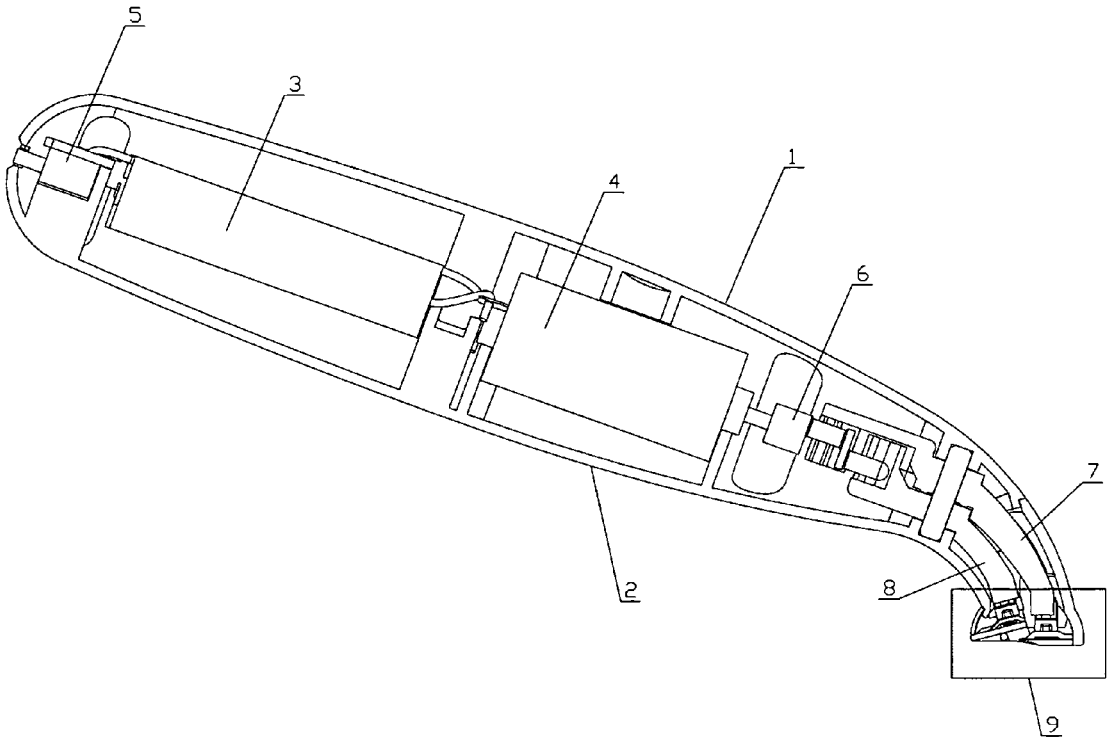
FIG. 1 illustrates a sectional view of the overall structure of the present invention according to Embodiment 1.
Figure 2:
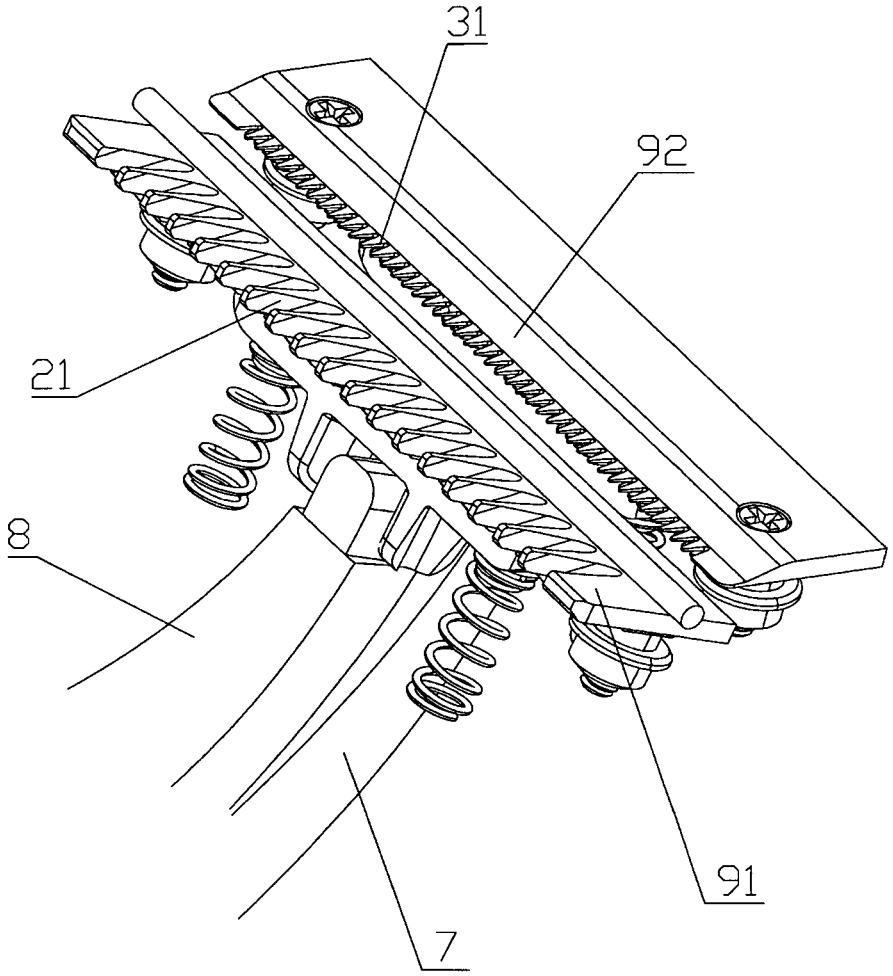
FIG. 2 illustrates a structural schematic view of the exposed blade head of FIG. 1 excluding the blade head cover case.
Figure 3:
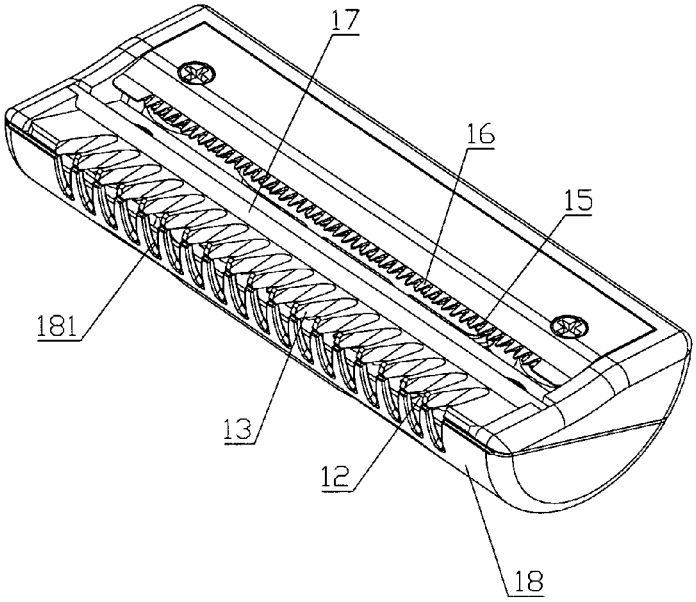
FIG. 3 illustrates a structural schematic view of the blade head of FIG. 2 including the blade cover case.
Figure 4:
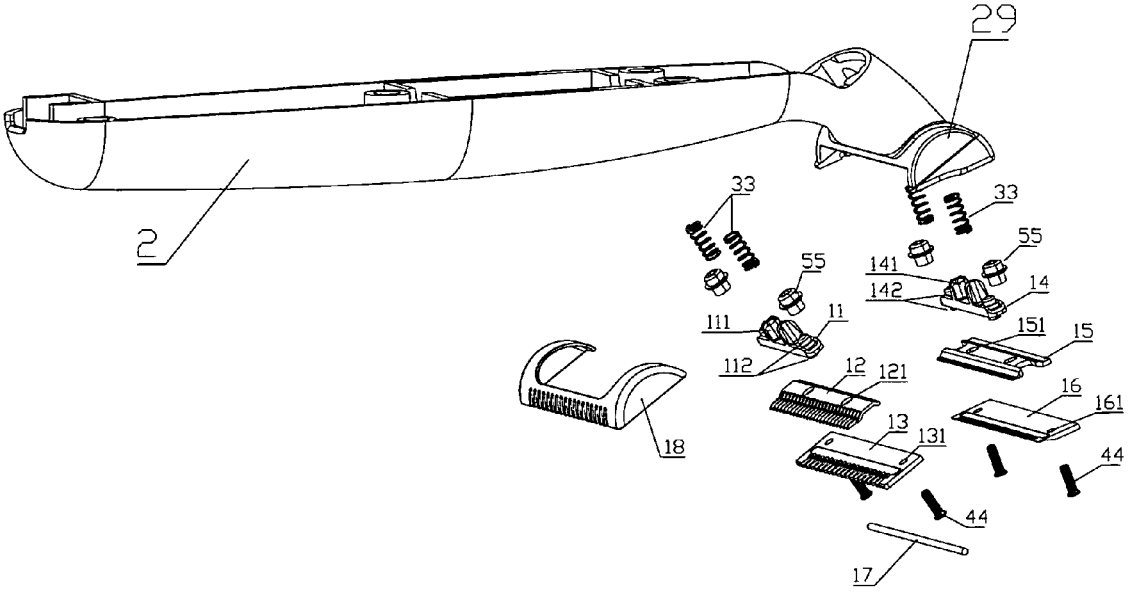
FIG. 4 illustrates an exploded schematic view of the blade head of FIG. 1.

As illustrated in FIGS. 1 to 4, the single-sided double-blade hair trimming device of the present invention comprises a top case 1 and a bottom case 2 which are engaged with each other to form a case. It further comprises a switch 5, a battery 3, a motor 4 and a double eccentric shaft 6 which are disposed inside the case and are connected in sequence from a rear end to a front end of the case. Two shaft ends of the double eccentric shaft 6 are respectively connected to a thin blade rocker arm 7 and a thick blade rocker arm 8. The thin blade rocker arm 7 and the thick blade rocker arm are connected to a blade head 9, wherein the switch 5, the battery 3 and the motor 4 are connected by circuits. The front end of the bottom case 2 is provided with a blade head cover case 29.

The blade head 9 comprises a thick blade assembly 91 and a thin blade assembly 92 which are disposed side by side and in the same direction. The thick blade assembly 91 comprises a first movable blade holder 11, a first movable blade 12 and a thick fixed blade 13. The thin blade assembly 92 comprises a second movable blade holder 14, a second blade 15 and a thin fixed blade 16. The lengths of the first movable blade holder 11 and the first movable blade 12 are shorter than the length of the thick fixed blade 13, whereas the lengths of the second movable blade holder 14 and the second movable blade 15 are shorter than the length of the thin fixed blade 16.

The thick fixed blade 13, the first movable blade 12, the thin fixed blade 16 and the second movable blade 15 each has an edge which is provided with a teeth section. The first movable blade 12 is sleeved within an inner side of the thick fixed blade 13, and the teeth sections thereof overlap with each other correspondingly. The first movable blade 12 moves reciprocally corresponding to the thick fixed blade 13; when the teeth sections thereof engage with each other, a thick blade trimming surface 21 is formed without any gaps therebetween. The second movable blade 15 is sleeved within an inner side of the thin fixed blade 16, and the teeth sections thereof overlap with each other correspondingly. The second movable blade 15 moves reciprocally corresponding to the thin fixed blade 16; when the teeth sections thereof engage with each other, a thin blade trimming surface 31 is formed without any gaps therebetween. The thick blade trimming surface 21 and the thin blade trimming surface 31 are disposed side by side and face the same direction.

The teeth section of the thick fixed blade 13 comprises serrated openings which are evenly arranged on an edge thereof along a lengthwise direction. The teeth section of the first movable blade 12 comprises a plurality of teeth which are evenly arranged on an edge thereof along a lengthwise direction; each of the teeth has a V-shaped pointing end, a V-shaped cross section, and two edges which are both disposed with blades. The teeth section of the thin fixed blade 16 comprises a plurality of teeth which are evenly arranged on an edge thereof along a lengthwise direction; each of the teeth has a V-shaped pointing end and two edges which are both disposed with blades. The teeth section of the second movable blade 15 comprises a plurality of teeth which are evenly arranged on an edge thereof along a lengthwise direction; each of the teeth has a V-shaped pointing end and two edges which are both disposed with blades.

The first movable blade holder 11 has a top side which is disposed with two protrusions 111 for clamping an end of the thick blade rocker arm 8, so as to fix the first movable blade holder 11 with the thick blade rocker arm 8. The top side and a bottom side of the first movable blade holder 11 are each disposed with two cylindrical positioning protrusions 112 at two ends thereof. The first movable blade 12 is disposed with two mounting holes 121 which fit with the two positioning protrusions 112 of the bottom side of the first movable blade holder 11. The first movable blade holder 11 and the first movable blade 12 are fixed with each other by engaging the two positioning protrusions 112 with the mounting holes 121. Two springs 33 are provided, with one end of each pressing against the blade head cover case 29 and the other end of each sleeved within each of the two positioning protrusions 112 disposed on the top side of the first movable blade holder 11; the first movable blade 12 is pressed by pressing the first movable blade holder 11. Two ends of the thick fixed blade 13 are each disposed with a screw hole 131. The thick fixed blade 13 is mounted on the blade head cover case 29 by engaging the blade locking screws 44 and the blade locking nuts 55. Specifically, the blade locking nuts 55 are first securely mounted into the blade head cover case 29; the thick fixed blade 13 is then placed thereon, and lastly the blade locking screws 44 are mounted. The first movable blade 12 and the first movable blade holder 11 are disposed between the thick fixed blade 13 and the blade head cover case 29. The teeth of the first movable blade 12 and the thick fixed blade 13 face the same direction.

The blade head 9 also comprises a blade head protection cover 18, which is engaged with the blade head cover case 29. The blade head protection cover 18 has a side edge which is provided with a row of openings 181 corresponding to density and size of the teeth of the thick fixed blade 13. The teeth of the thick fixed blade 13 are engaged with an end of the row of openings 181. The teeth of the first movable blade 12 are concealed within a cavity formed by the engagement of the teeth of the thick fixed blade 13 and the row of openings 181.

The second movable blade holder 14 has a top side which is disposed with two protrusions 141 for clamping an end of the thin blade rocker arm 7, so as to fix the second movable blade holder 14 and the thin blade rocker arm 7. The top side and a bottom side of the second movable blade holder 14 are each disposed with two cylindrical positioning protrusions 142 at two ends thereof. The second movable blade 15 comprises two mounting holes 151 which fit with the two positioning protrusions 142 of the bottom side of the second movable blade holder 14. The second movable blade holder 14 and the second movable blade 15 are fixed with each other by engaging the two positioning protrusions 142 with the mounting holes 151. Two springs 33 are provided, with one end of each pressing against the blade head cover case 29 and the other end of each sleeved within each of the two positioning protrusions 142 disposed on the top side of the second movable blade holder; the second movable blade 15 is pressed by pressing the second movable blade holder 14. Two ends of the thin fixed blade 16 are each disposed with a screw hole 161. The thin fixed blade 16 is mounted on the blade head cover case 29 by engaging the blade locking screws 44 and the blade locking nuts 55. Specifically, the blade locking nuts 55 are first securely mounted into the blade head cover case 29; the thin fixed blade 16 is then placed thereon, and lastly the blade locking screws 44 are mounted. The second movable blade 15 and the second movable blade holder 14 are disposed between the thin fixed blade 16 and the blade head cover case 29. The teeth of the second movable blade 15 and the thin fixed blade 16 face the same direction.

The blade head 9 also comprises a blade head protection line 17 which is disposed between the thick fixed blade 13 and the thin fixed blade 16, and is parallel to the edges of the thick fixed blade 13 and the thin fixed blade 16 which are disposed with teeth sections, wherein the two ends thereof are fixed onto an inner side surface of the blade head cover case 29 so as to stretch the skin which has been shaved by the first movable blade 12, thereby preventing the skin from bulging and being cut by the second movable blade 15.

The blade head protection line 17 can be an elongated component of the blade head cover case 29 which is disposed between the thick blade assembly 91 and the thin blade assembly 92.

The blade head protection line can be a wall-like elongated protrusion protruded from a surface of the thick fixed blade 13.

The thick fixed blade 13 forms a certain angle with the thin fixed blade 16, or the two are on the same plane.

The teeth of thin fixed blade 16 are ultrathin with a thickness of less than 0.1 mm, preferably 0.07 mm.

The teeth of thick fixed blade 13 can be separated from the end of the row of openings 181 of the blade head protection cover 18, and thus leaving a gap therebetween. This allows the hair inside the blade head cover case 29 to be washed away from the gap.

Embodiment 2

Figure 5:
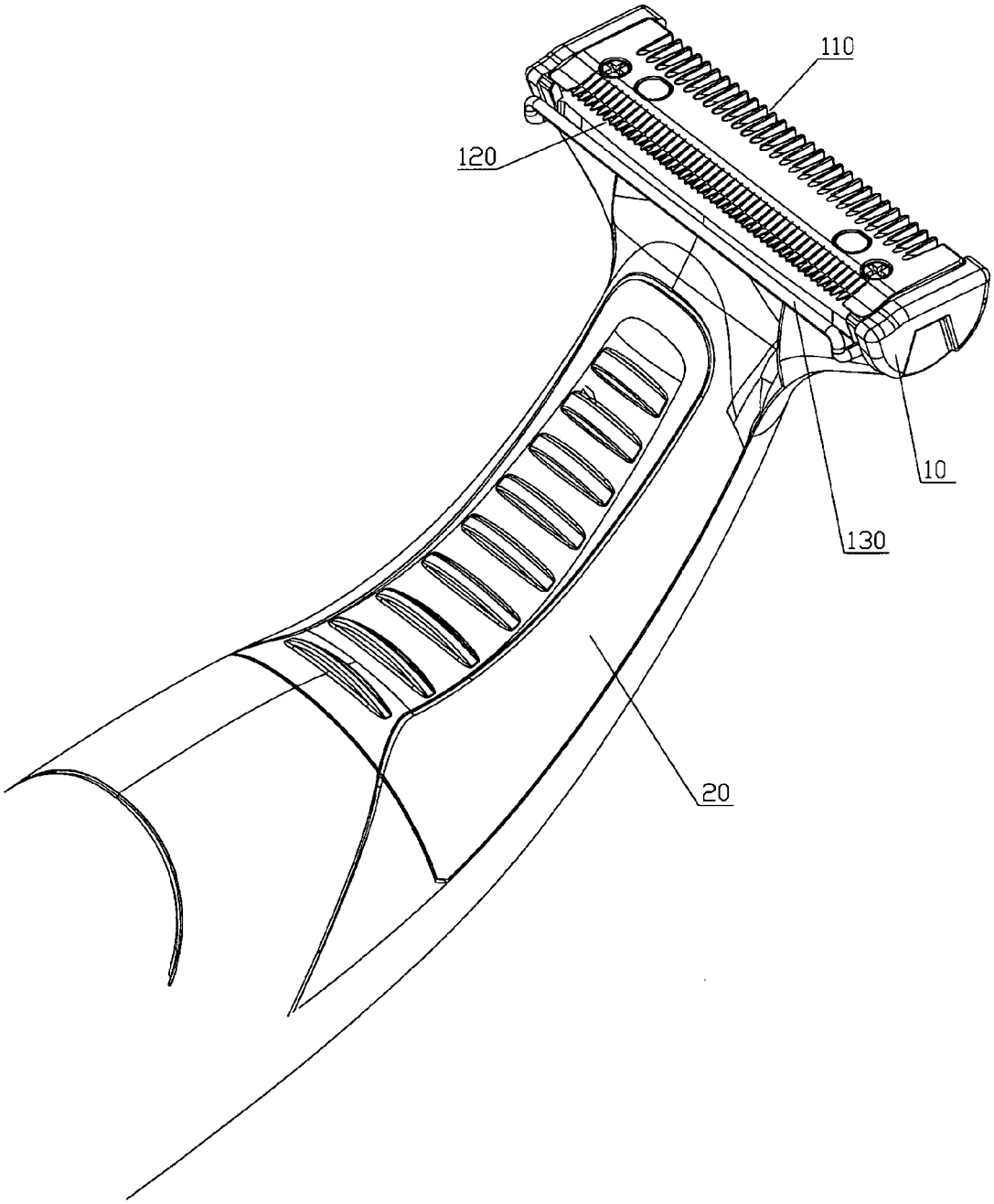
FIG. 5 illustrates a schematic view of the overall structure of the present invention according to Embodiment 2.
Figure 6:
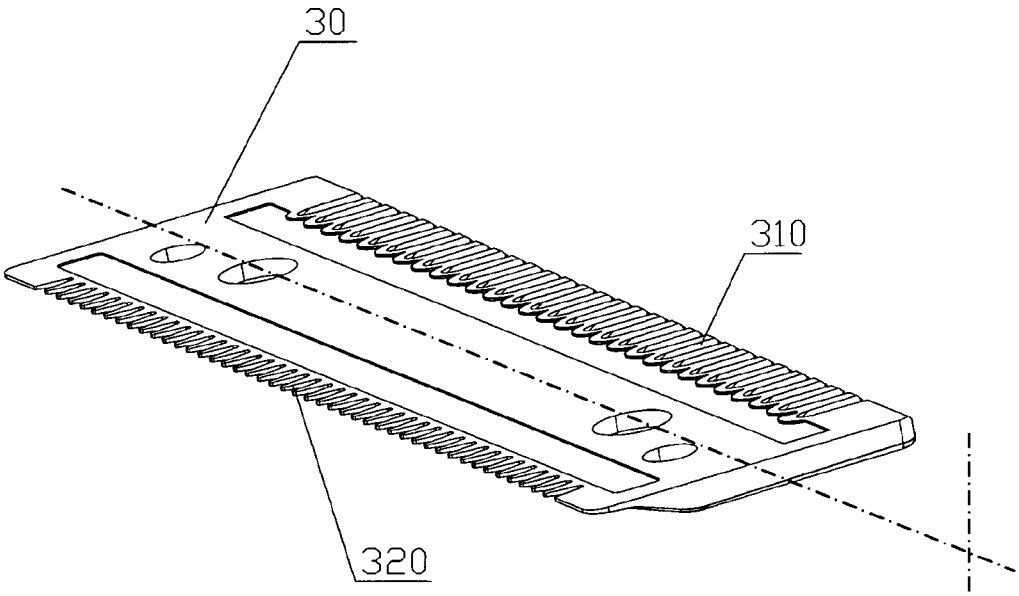
FIG. 6 illustrates a structural schematic view of the fixed blade.
Figure 7:
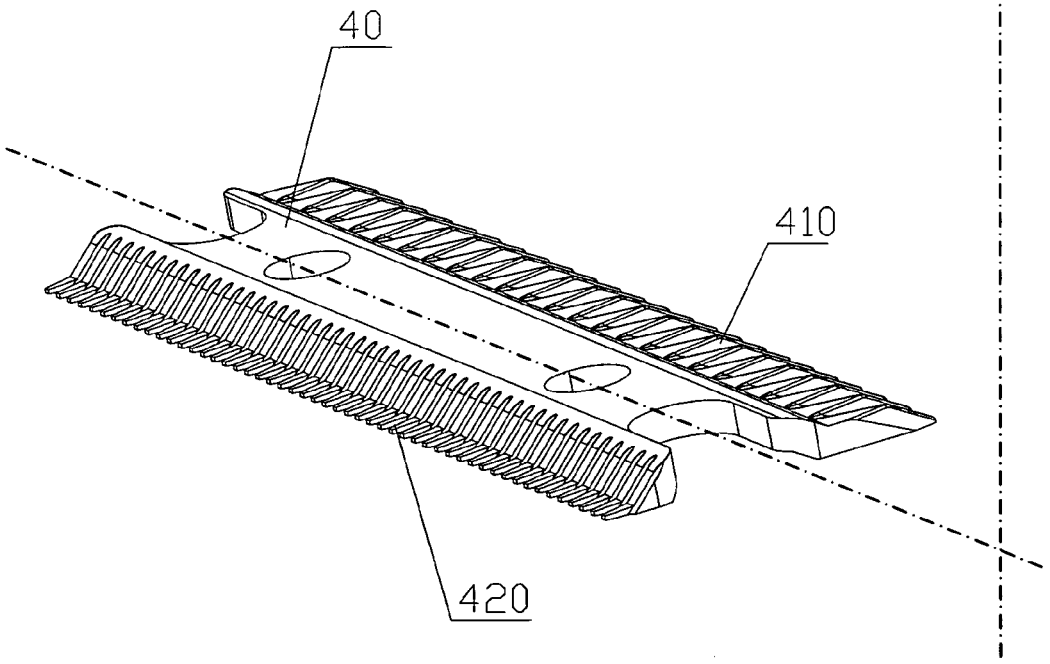
FIG. 7 illustrates a structural schematic view of the movable blade.
Figure 8:
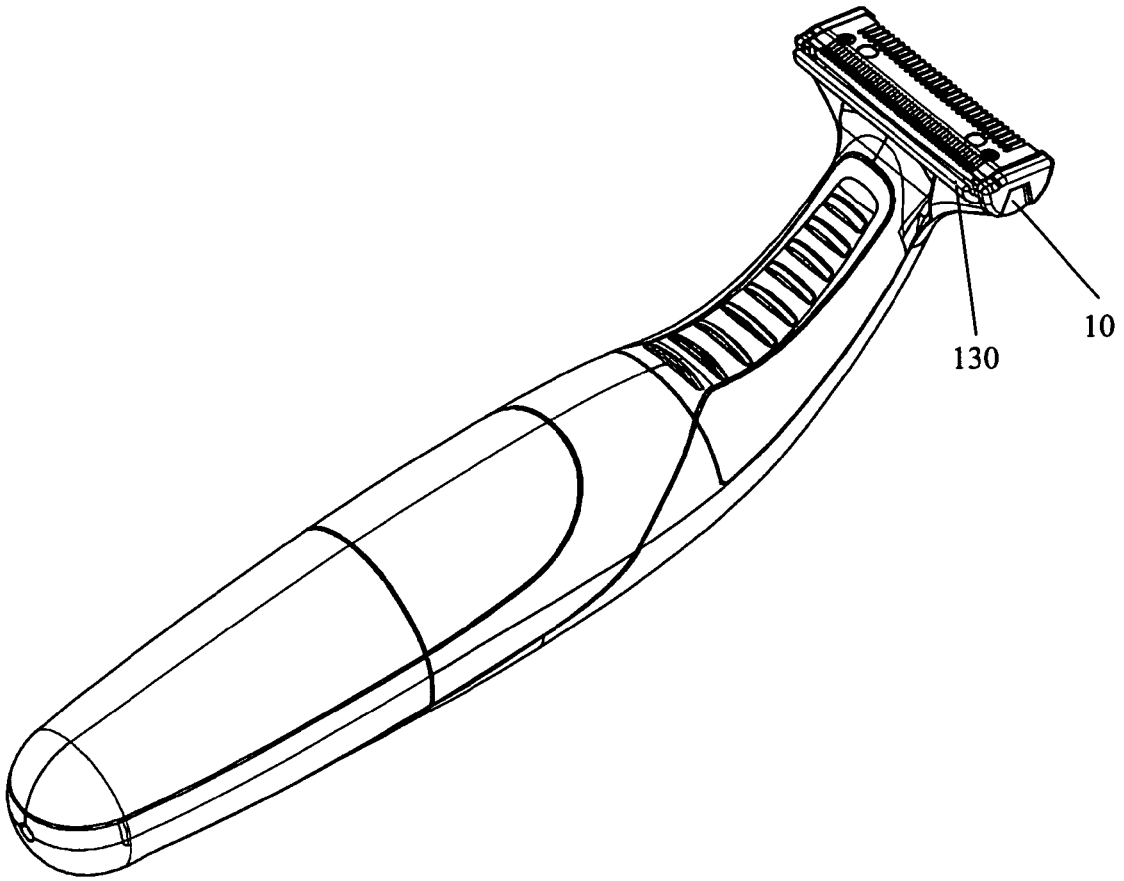
FIG. 8 illustrates an alternative configuration of the protection line according to Embodiment 2 of the present invention, wherein the protection line is shown is an elongated protrusion on a surface of the double-blade hair trimmimng device.
Figure 9:
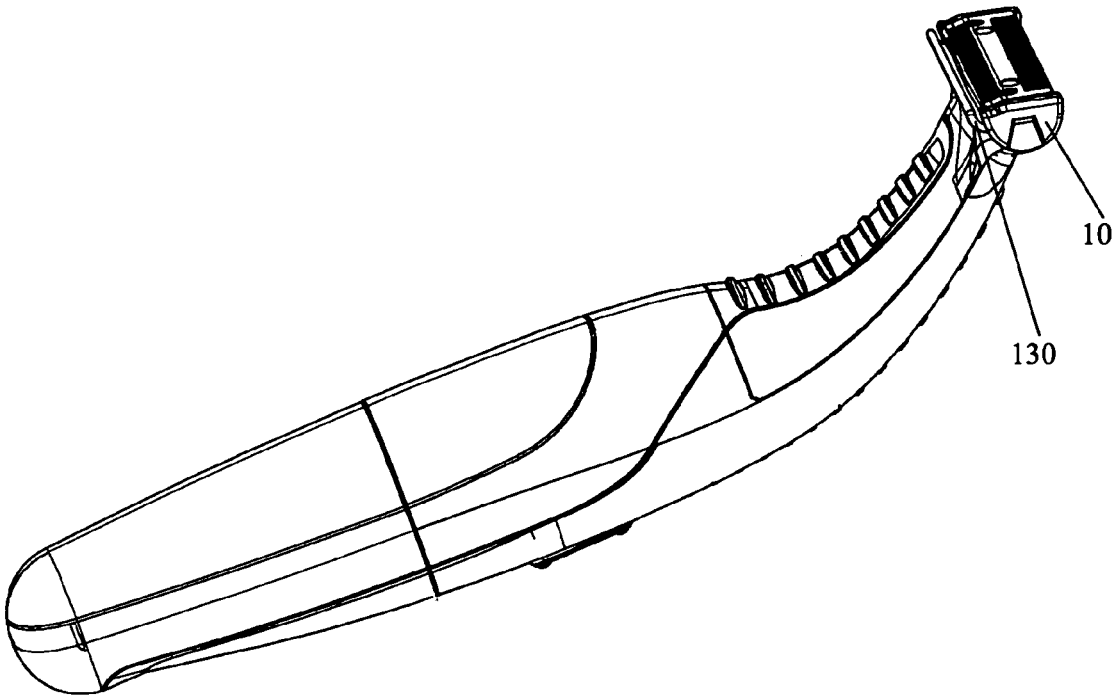
FIG. 9 is the same as FIG. 8, but shown in another perspective view.
Figure 10:
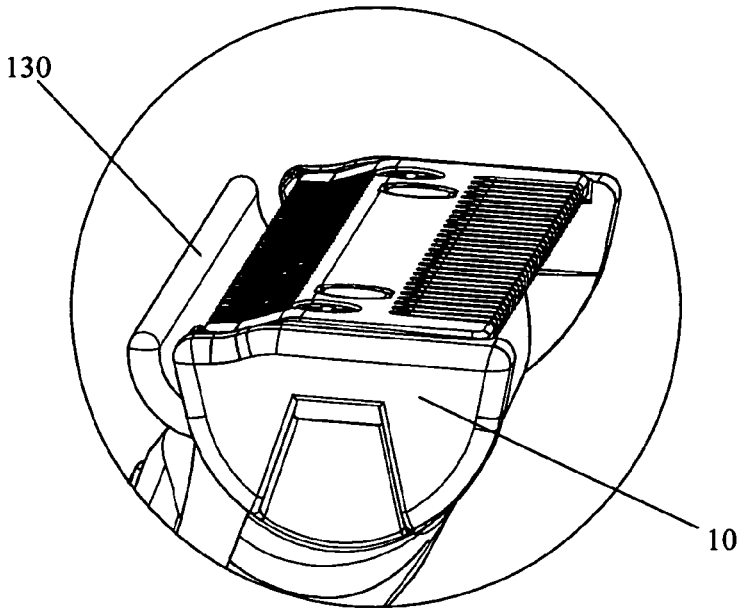
FIG. 10 is an enlarged view of the blade head shown in FIG. 8.

As illustrated in FIGS. 5 to 7, the double-sided double-blade trimming device of the present embodiment comprises a blade body 20 and a blade head 10. The blade body 20 is disposed with a driving device therein. The blade head 10 comprises a thick blade teeth edge 110 and a thin blade teeth edge 120.

Specifically, the blade head 10 comprises a fixed blade 30 and a movable blade 40. Axes of the fixed blade 30 and the movable blade 40 overlap. The fixed blade 30 and the movable blade 40 are each provided with teeth sections 310, 320, 410, 420 at two opposite edges thereof. The fixed blade 30 is sleeved within an inner side of the movable blade 40. The teeth sections 310, 410 of the fixed blade 30 and the movable blade 40 overlap with each other correspondingly; the teeth sections 320, 420 overlap with each other correspondingly. The movable blade 40 moves reciprocally corresponding to the fixed blade 30 to trim away the hair. One of the edges of the fixed blade 30 is relatively thicker than the edge opposite thereto. One of the edges of the movable blade 40 is relatively thicker than the edge opposite thereto. The thicker edge of the fixed blade 30 overlaps with one of the edges of the movable blade 40 to form the thick blade teeth edge 110. The thinner edge of the fixed blade 30 overlaps with the other edge of the movable blade 40 to form the thin blade teeth edge 120. Inner sides of the teeth sections 310, 320 of the fixed blade of the fixed blade teeth edge 110 and the thin blade teeth edge 120 are engaged with outer sides of the teeth sections 410, 420 of the movable blade without any gaps to form trimming surfaces for hair trimming.

The teeth section 310 of the thicker edge of the fixed blade 30 comprises serrated openings which are evenly arranged along a lengthwise direction of that edge. The teeth section 320 of the thinner edge of the fixed blade 30 comprises a plurality of teeth which are evenly arranged along a lengthwise direction of that edge; each of the teeth has a V-shaped pointing end, and two edges which are both disposed with blades.

The teeth section 410 of the thicker edge of the movable blade 40 comprises a plurality of teeth which are evenly arranged along a lengthwise direction of that edge; each of the teeth has a V-shaped pointing end, a V-shaped cross section, and two edges which are both disposed with blades. The teeth section 420 of the thinner edge of the movable blade 40 comprises a plurality of teeth which are evenly arranged along a lengthwise direction of that edge; each of the teeth has a V-shaped pointing end and two edges which are both disposed with blades.

The blade head 10 also comprises a blade head protection line 130 which is disposed at a side of the thin blade teeth edge 120 which is far away from the thick blade teeth edge 110.

The blade head protection line 130 is an independent component, with its two ends fixed onto a case of the double-sided double-blade hair trimming device.

The blade head protection line 130 can also be an elongated protrusion on a surface of the case of the double-sided double-blade hair trimming device. It is parallel to both the thick blade teeth edge 110 and the thin blade teeth edge 120.

The teeth section 320 of the thinner edge of the fixed blade 30 has a tooth thickness of less than 0.1 mm.

The tooth thickness of the teeth sections of the two opposite edges of the movable blade 40 can be the same. After trimming, the length of the hair is determined by the tooth thickness of the teeth section of the fixed blade 30, therefore the present embodiment does not set limits to the relative thickness and absolute thickness of the teeth sections of the two opposite edges of the movable blade 40.

The above embodiments described in greater detail are only a few embodiments of the present invention and should not limit the scope of the present invention. To any person skilled in this field of art, any change and modification without deviating from the concept of the present invention should also fall within the scope of protection of the present invention. The scope of protection of the present invention should be limited by the Claims.

What is claimed is:

1. A double-blade hair trimming device comprising a trimmer handle, a blade head, and a driving device disposed inside the trimmer handle, wherein the blade head comprises a fixed blade and a movable blade; axes of the fixed blade and the movable blade overlap; the fixed blade is provided with a first teeth section and a second teeth section having a plurality of teeth, the first teeth section and the plurality of teeth of the second teeth section defining two opposite edges thereof respectively, and the movable blade is provided with a third teeth section and a fourth teeth section defining two opposite edges thereof respectively; the edge of the fixed blade provided with the first teeth section is thicker than the opposite edge provided with the second teeth section; the edge of the fixed blade provided with the first teeth section overlaps the edge of the movable blade provided with the third teeth section to form a thick blade teeth edge; the edge of the fixed blade provided with the second teeth section overlaps the edge of the movable blade provided with the fourth teeth section to form a thin blade teeth edge; the thick blade teeth edge and the thin blade teeth edge are disposed side by side; the thick blade teeth edge and the thin blade teeth edge are oriented in mutually opposite directions; each of the teeth of the second teeth section of the fixed blade has a tooth thickness of less than 0.1 mm;

the blade head also comprises a blade head protection device which is disposed at a side of the thin blade teeth edge away from the thick blade teeth edge; the blade head protection device has a top side parallel to both the thin blade teeth edge and the thick blade teeth edge and located on a same plane as an outer top surface of the fixed blade.

2. The double-blade hair trimming device as in claim 1, the fixed blade defines a longitudinal axis; wherein the edge of the first teeth section of the fixed blade comprises serrated openings which are evenly arranged along the longitudinal axis; the plurality of teeth of the second teeth section are evenly arranged along the longitudinal axis, and wherein each of the teeth of the second teeth section has a V shape having two cutting edges converging to define the edge of the second teeth section.

3. The double-blade hair trimming device as in claim 1, the movable blade defines a longitudinal axis; wherein the third and the fourth teeth section of the movable blade each comprise a plurality of teeth, wherein each of the teeth of the third teeth section have a V-shaped cross section having two cutting edges converging to define the edge of the third teeth section, and wherein each of the teeth of the fourth teeth section have a V-shaped cross section having two cutting edges converging to define the edge of the fourth teeth section.

4. The double-blade hair trimming device as in claim 1, wherein the blade head protection device has two ends fixed onto the blade head.

5. The double-blade hair trimming device as in claim 1, wherein the blade head protection device is an elongated protrusion on a surface of the blade head.

* * * * *